US006533046B2

(12) United States Patent
Mills et al.

(10) Patent No.: US 6,533,046 B2
(45) **Date of Patent: *Mar. 18, 2003**

(54) PIPE LOADING DEVICE FOR A DIRECTIONAL DRILLING APPARATUS

(75) Inventors: Matthew Arlen Mills, Pella, IA (US); Gregg Alan Austin, Pella, IA (US); Steven C. Erickson, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/970,093

(22) Filed: Oct. 2, 2001

(65) Prior Publication Data

US 2002/0079137 A1 Jun. 27, 2002

Related U.S. Application Data

(63) Continuation of application No. 09/321,988, filed on May 28, 1999, now Pat. No. 6,332,502.

(51) Int. Cl.[7] ..... E21B 19/02
(52) U.S. Cl. ..... 175/52; 414/22.62
(58) Field of Search ..... 175/52, 85; 166/77.51; 414/22.51, 22.52, 22.53, 22.63, 22.64, 22.62

(56) References Cited

U.S. PATENT DOCUMENTS

| | | | |
|---|---|---|---|
| 2,280,854 | A | 4/1942 | Rooney |
| 2,829,783 | A | 4/1958 | Blagg |
| 3,506,075 | A | 4/1970 | Attebo |
| 3,937,514 | A | 2/1976 | Langowski |
| 4,049,065 | A | 9/1977 | Walter |
| 4,128,135 | A | 12/1978 | Mitchhart et al. |
| RE30,071 | E | 8/1979 | Hilding et al. |
| 4,491,450 | A | 1/1985 | George |
| 5,355,965 | A | 10/1994 | Rozendaal |
| 5,460,480 | A | 10/1995 | Jubre et al. |
| 5,556,253 | A | 9/1996 | Rozendaal et al. |
| 5,607,280 | A | 3/1997 | Rozendaal |
| 5,931,238 | A | 8/1999 | Gilmore et al. |
| 6,085,852 | A | 7/2000 | Sparks et al. |

FOREIGN PATENT DOCUMENTS

| | | |
|---|---|---|
| DE | 197 15 082 A1 | 9/1997 |
| GB | 2 166 781 A | 5/1986 |
| GB | 2 312 006 | 10/1997 |
| WO | WO 95/00737 | 1/1995 |
| WO | WO 96/26349 | 8/1996 |

OTHER PUBLICATIONS

US 5,806,613, 9/1998, Sparks et al. (withdrawn)

*Primary Examiner*—Robert E. Pezzuto
*Assistant Examiner*—Meredith Petravick
(74) *Attorney, Agent, or Firm*—Merchant & Gould P.C.

(57) ABSTRACT

A drilling apparatus including a magazine for holding a plurality of pipes, and a drive head is disclosed herein. The drive head includes a drive member adapted to be coupled to a pipe. The drive member is aligned along a drive axis. The drilling apparatus includes a first drive mechanism for rotating the drive member about the drive axis, and a second drive mechanism for moving the drive member axially along the drive axis. The drilling apparatus also includes a pipe transfer member for transferring pipes between the magazine and the drive head. The pipe transfer member defines a pipe receiving region for receiving a pipe. The pipe transfer member is movable between a first orientation in which the pipe receiving region is located under the magazine, and a second orientation in which the pipe receiving region is located adjacent to the drive axis of the drive head. The drilling apparatus further includes a pipe retainer that moves to a retaining position only when the pipe receiving region is located under the magazine.

11 Claims, 10 Drawing Sheets

PIPE LOADING DEVICE FOR A DIRECTIONAL DRILLING APPARATUS

This application is a continuation of application Ser. No. 09/321,988, filed May 28, 1999, now U.S. Pat. No. 6,332,502 which application(s) are incorporated herein by reference.

FIELD OF THE INVENTION

The present invention relates generally to pipe loading devices. More particularly, the present invention relates to pipe loading devices for use with directional drilling machines.

BACKGROUND OF THE INVENTION

Directional drilling machines are used to drill holes along a generally horizontal path beneath the ground. After a hole is drilled, a length of cable or the like can be passed through the hole. Such directional drilling machines eliminate the need for digging a long trench to lay a length of cable or the like.

A typical directional drilling machine includes an elongated track that can be aligned at an inclined orientation relative to the ground. A drive head is mounted on the track so as to be moveable along the length of the track. The drive head includes a drive member that is rotated about a drive axis that is generally parallel to the track. The drive member is adapted for connection to a length of pipe. For example, the drive member can include a threaded end having either female or male threads.

To drill a hole using the directional drilling machine, the track is oriented at an inclined angle relative to the ground, and the drive head is retracted to an upper end of the track. Next, a length of pipe is unloaded from a magazine and is coupled to the drive member of the drive head. Once the pipe is connected to the drive head, the drive head is driven in a downward direction along the inclined track. As the drive head is driven downward, the drive member is concurrently rotated about the drive axis. Typically, a cutting element is mounted at the distal end of the pipe. Consequently, as the drive head is driven down the track, the rotating pipe is pushed into the ground thereby causing the pipe to drill or bore a hole. By stringing multiple pipes together, it is possible to drill holes having relatively long lengths.

After drilling a hole, it is common for a back reamer to be connected to the end of the drill string. Once the back reamer is connected to the end of the drill string, the directional drilling apparatus is used to pull the string of pipes back toward the drilling machine. As the string of pipes is pulled back toward the drilling machine, the reamer enlarges the pre-drilled hole, and the pipes are individually uncoupled from the drill string and loaded back into the magazine of the directional drilling machine.

To enhance drilling productivity, it is important to maximize the efficiency in which pipes can be loaded into and unloaded from the magazine of a directional drilling machine. Until fairly recently, pipes were manually carried between the magazine and the drive head of a drilling machine, and were also manually loaded into and unloaded from the magazine. Recent developments have improved pipe loading and unloading efficiencies through automation. For example, U.S. Pat. No. 5,556,253 to Rozendaal et al. (the '253 patent), and U.S. Pat. No. 5,607,280 (the '280 patent) to Rozendaal, disclose improved pipe loading/unloading devices. The '253 and '280 patents disclose devices that effectively use gravity to automatically unload pipes from a magazine. The '253 and '280 patents also disclose devices each having pipe transfer members that automatically move pipes between a magazine and a drive head. The advances provided by the devices disclosed in the '253 and '280 patents have assisted in significantly improving a drill operator's ability to enhance drilling productivity.

SUMMARY OF THE INVENTION

One aspect of the present invention relates to a drilling apparatus including a magazine for holding a plurality of pipes, and a drive head having a drive member adapted to be coupled to a pipe. The drive member is aligned along a drive axis. The drilling apparatus also includes a first drive mechanism for rotating the drive member about the drive axis, and a second drive mechanism for moving the drive member axially along the drive axis. The drilling apparatus is provided with a pipe transfer member for transferring pipes between the magazine and the drive head. The pipe transfer member defines a pipe receiving region for receiving or holding a pipe. The pipe transfer member is movable between a first orientation in which the pipe receiving region is positioned adjacent to the magazine, and a second orientation in which the pipe receiving region is positioned adjacent to the drive axis of the drive head. The drilling apparatus further includes a magnet for magnetically attracting a pipe received within the pipe receiving region of the pipe transfer member at least when the pipe transfer member is in the second orientation. The magnet is adapted to magnetically hold the pipe in coaxial alignment with the drive axis while the drive member of the drive head is being coupled to the pipe or uncoupled from the pipe.

Another aspect of the present invention relates to a drilling apparatus including a magazine for holding a plurality of pipes, and a drive head having a drive member adapted to be coupled to a pipe. The drive member is aligned along a drive axis and is rotated about the drive axis by a first drive mechanism. A second drive mechanism is provided for moving the drive member axially along the drive axis. The drilling apparatus also includes a pipe transfer member for transferring pipes between the magazine and the drive head. The pipe transfer member defines a pipe receiving region for receiving a pipe. The pipe transfer member is movable between a first orientation in which the pipe receiving region is located adjacent to the magazine, and a second orientation in which the pipe receiving region is located adjacent to the drive axis of the drive head. The drilling apparatus further includes a holding means for attracting a pipe received within the pipe receiving region of the pipe transfer member toward a gripping surface at least when the pipe transfer member is in the second orientation. The holding means is adapted to hold the pipe against the gripping surface such that the pipe is held in coaxial alignment with the drive axis while the drive member of the drive head is being coupled to the pipe or uncoupled from the pipe.

A further aspect of the present invention relates to a method for coupling a pipe to a drilling apparatus. The drilling apparatus includes a drive head having a drive member adapted to be coupled to a pipe. A first drive mechanism rotates the drive member about the drive axis, while a second mechanism axially moves the drive head along the drive axis. The method includes moving the pipe into coaxial alignment with the drive axis, and magnetically attracting the pipe against a magnetic gripping surface to hold the pipe in coaxial alignment with the drive axis. The pipe is then coupled to the drive member while the pipe is magnetically held in coaxial alignment with the drive axis.

Still another aspect of the present invention relates to a method for loading a magazine of a drilling apparatus. The drilling apparatus includes a drive head having a drive member coupled to a pipe. The drilling apparatus also includes a first drive mechanism for rotating the drive member about a drive axis, and a second drive mechanism for moving the drive head axially along the drive axis. The method includes providing a pipe transfer member having a pipe receiving region, and moving the pipe transfer member such that the pipe coupled to the drive member is received at the pipe receiving region. The method also includes uncoupling the pipe from the drive member, and magnetically attracting the uncoupled pipe against a magnetic gripping surface to hold the pipe at the pipe receiving region. The method further includes moving the pipe transfer member such that the uncoupled pipe is conveyed to a magazine, and loading the uncoupled pipe into the magazine.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate various aspects of the invention and together with the description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

I. General Description

Figure 1:
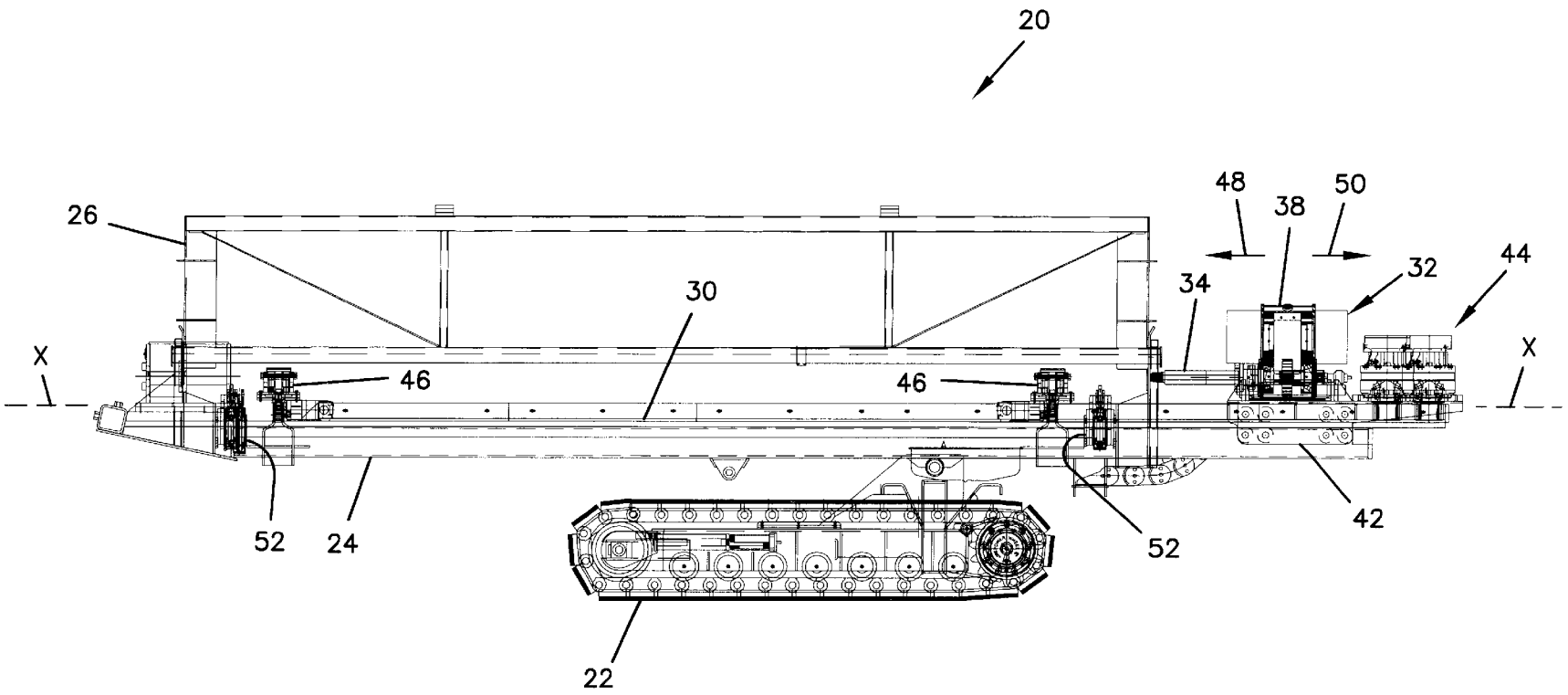
FIG. 1 is a side elevational view of a directional drilling or boring machine constructed in accordance with the principles of the present invention.

FIG. 1 shows a drilling apparatus 20 (e.g., a directional boring machine) constructed in accordance with the principles of the present invention. The drilling apparatus 20 includes a pair of drive tracks 22 (only one shown) for propelling the drilling apparatus 20 along the ground. A frame 24 is pivotally mounted above the drive tracks 22. A magazine 26 for holding a plurality of pipes is supported on the frame 24. An elongated track 30 is also supported on the frame 24. A drive head 32 is mounted on a carriage 42 that is coupled to the elongated track 30. The drive head 32 includes a drive member 34 adapted to be coupled to a pipe (e.g., the drive member 34 includes a threaded end 36 that can be threaded within a pipe). A drive mechanism 38 is provided for rotating the drive member 34 about a longitudinal drive axis X—X that is generally parallel with respect to the elongated track 30, and a drive mechanism 44 is provided for moving the carriage 42 back and forth along the elongated track 30. A pair of pipe transfer members 46 are used to convey pipes between the magazine 26 and the drive head 32.

The drilling apparatus 20 is used to push a drill string of pipes into the ground to bore a hole. To start the drilling sequence, the frame 24 is pivoted relative to the drive tracks 22 such that the elongated track 30 is inclined relative to the ground. Also, the carriage 42 is moved to a start position as shown in FIG. 1. A first pipe is then removed from the magazine 26 by the pipe transfer members 46 and placed in coaxial alignment with the drive axis X—X of the drive head 32. With the pipe aligned along the drive axis X—X, one end of the pipe is coupled to the drive member 34 of the drive head 32. Preferably, a cutting member (e.g., a drill head) is positioned at the other end of the pipe. Once the pipe has been coupled to the drive member 34, the drive mechanism 38 is used to rotate the pipe about the drive axis X—X. Concurrently, a push stroke is initiated such that the rotating pipe is drilled into the ground. During the push stroke, the drive mechanism 44 moves the carriage 42 in a direction 48 along the track 30. As is conventionally known in the art, drilling fluids can be used to facilitate drilling operations.

After the push stoke has been completed, the drive member 34 of the drive head 32 is uncoupled from the pipe and a return/pull stroke is initiated such that the carriage 42 returns to the start position of FIG. 1. During the return/pull stroke, the drive mechanism 44 moves the carriage 42 in a direction 50 along the track 30. With the carriage 42 returned to the start position, a second pipe is removed from the magazine 26 and placed in coaxial alignment with the drive axis X—X. As so aligned, the second pipe is coupled to both the drive member 34 and the first pipe to form a drill string. Thereafter, a push stroke is again initiated such that the entire drill string is pushed further into the ground. By repeating the above steps, additional pipes can be added to the drill string thereby increasing the length of the hole that is being drilled by the drilling apparatus.

Once the hole has been drilled to a desired length, it is common to enlarge the hole through a back reaming process. For example, a back reamer can be attached to the distal end of the drill string. Additionally, product desired to be placed in the hole (e.g., a cable, a duct or the like) can also be connected to the distal end of the drill string. The drill string is then rotated and pulled back toward the drilling apparatus by the drive head 32. For example, the drive head 32 is connected to the drill string and then a return/pull stroke is initiated causing drill string to be pulled in the direction 50. As the drill string is pulled back to the drilling apparatus 20, the back reamer enlarges the previously drilled hole and the product is pulled into the enlarged hole. With each pull/return stroke of the drive head 32, a pipe is removed from the ground. A conventional scraper (not shown) can be used to remove earth residue from the pipes as the pipes are extracted. The extracted pipes are then uncoupled from the drill string and the pipe transfer members 46 are used to convey the pipes back to the magazine 26. Preferably, pipe lifts 52 are used to push the pipes from the pipe transfer members 46 back into the magazine 26.

An important aspect of the present invention relates to a holding structure (i.e., a pipe grip) for holding the pipes on the pipe transfer members 46. In this regard, a pipe attracting structure (e.g., a magnet or vacuum head) capable of attracting a pipe toward a gripping surface is preferably used. The gripping surface, via the attractive force provided the pipe attracting structure, holds, aligns, grasps, grips or otherwise retains the pipe at a desired location on the pipe transfer members. The phrase "gripping surface" is intended to include or mean any surface against which a pipe can be held by an attractive force such as a magnetic force or a suction force. Because the pipe attracting structure attracts the pipe toward the gripping surface, the gripping surface need only engage one side of the pipe to hold the pipe. Therefore, unloading of pipes from the pipe transfer members 46 is facilitated. Similarly, loading of pipes to the pipe transfer members is also facilitated.

II. The Magazine

Figure 2:
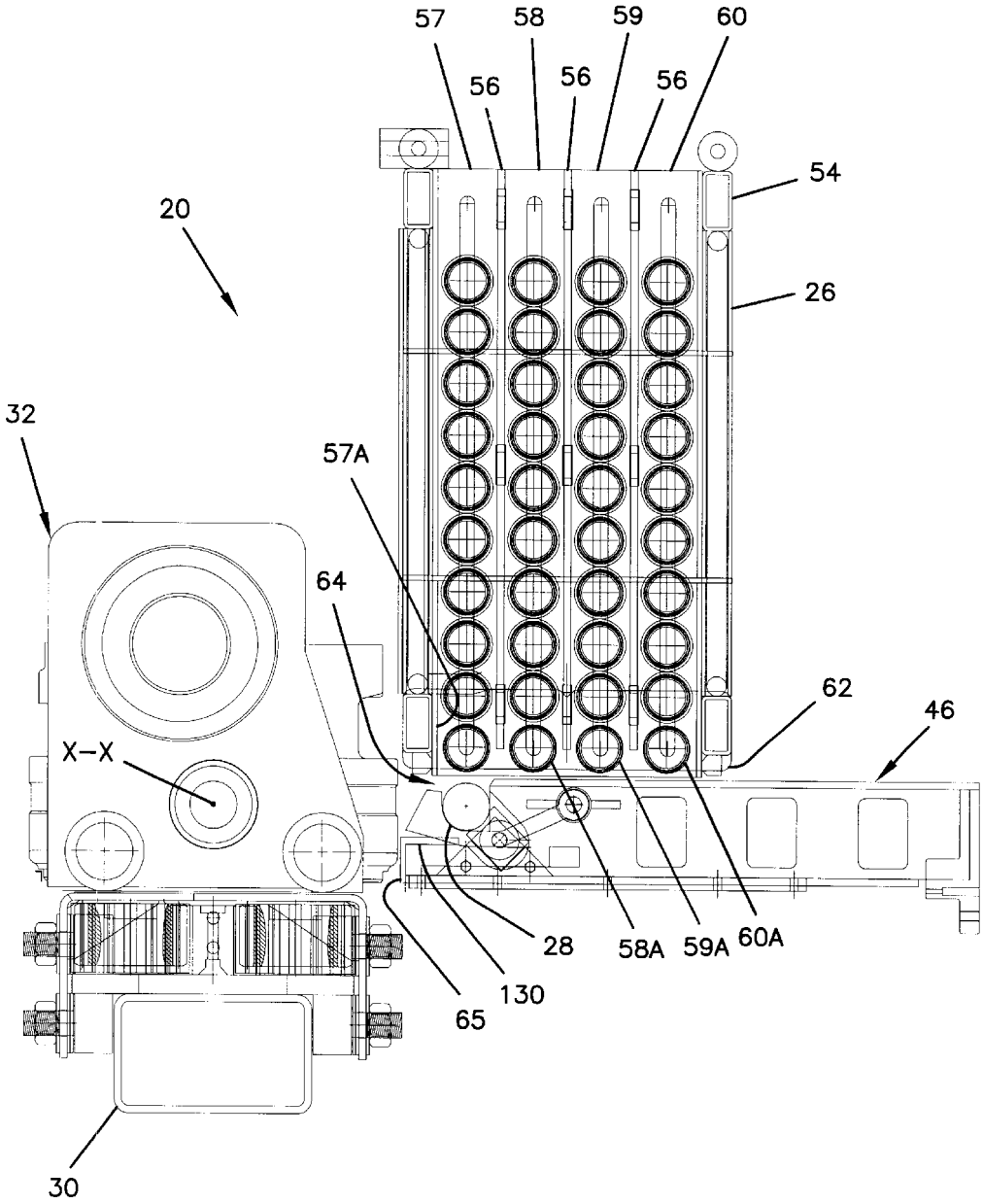
FIG. 2 is an end elevational view of the machine of FIG. 1, a pipe transfer member of the machine is shown in a retracted orientation.
Figure 3:
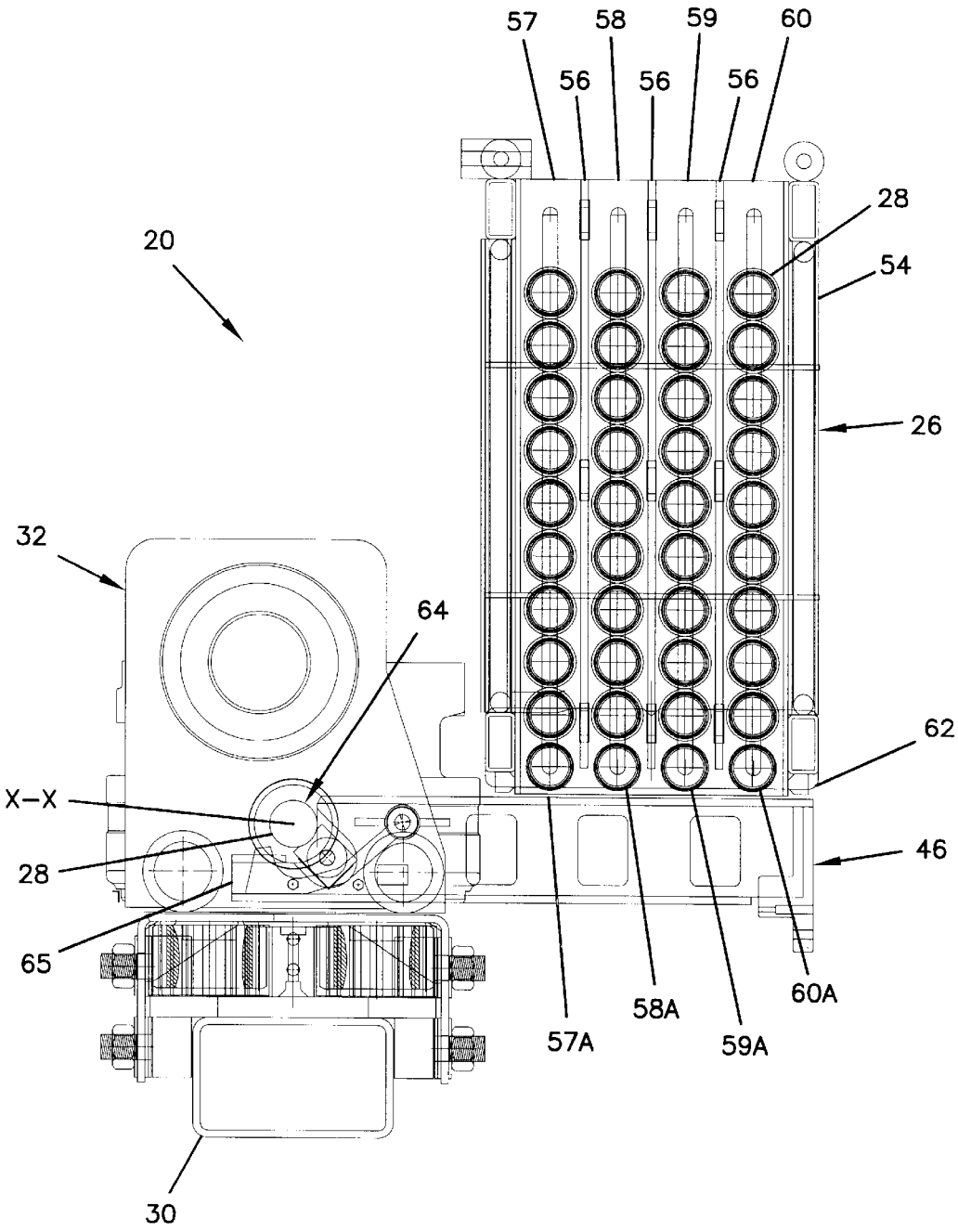
FIG. 3 is an end elevational view of the machine of FIG. 1 with the pipe transfer member in an extended orientation.

Referring to FIGS. 2 and 3, the magazine 26 of the drilling apparatus 20 includes a box-shaped frame 54 having a plurality of dividing walls 56. The walls 56 divide the magazine 26 into a plurality of columns 57–60. The column 57 nearest the drive head 32 is referred to as a first column. The column 60 farthest from the drive head 32 is referred to as an end column. Each of the columns 57–60 is shown containing a plurality of pipes 28 with the pipes aligned vertically within each of the columns 57–60 and with the pipes axes parallel to the drive axis X—X of the drive head 32. The columns 57–60 are each provided with a width approximately equal to the width of one of the pipes 28.

Referring again to FIGS. 2 and 3, the magazine 26 has a bottom end 62 that is open such that the spaces between the dividing walls 56 define a plurality of discharge openings 57A–60A. In a preferred embodiment, the pipes 28 are gravity discharged through the openings 57A–60A.

In the example shown, the magazine 26 has four columns each containing ten pipes. It will be appreciated that the magazine 26 can be provided with more or fewer columns and with more or fewer pipes per column. Also, the magazine can be configured such that the columns are adapted to discharge pipes through a single discharge opening. Consequently, separate discharge openings are not required for each column. Additionally, the magazine can be configured to define a single open bin for holding pipes, and one or more discharge openings for allowing pipes to be removed from the bin. Furthermore, non-gravity feed magazines can also be used.

III. The Pipe Transfer Members

As described above, the transfer members 46 are used to convey pipes between. the magazine 26 and the drive head 32. The pipe transfer members 46 each have substantially identical configurations and are simultaneously moved between a retracted orientation (shown in FIG. 2) and an extended orientation (shown in FIG. 3).

Referring to FIGS. 2–5, one of the pipe transfer members 46 is shown. The illustrated pipe transfer member 46 includes a pipe receiving region 64 positioned at an end 65 of the pipe transfer member that is closest to the drive head 32. When the pipe transfer member 46 is in the retracted orientation of FIG. 2, the pipe receiving region 64 is preferably located beneath the magazine 26 (e.g., directly beneath a selected one of the magazine discharge openings 57A–60A). By contrast, when the pipe transfer member 46 is in the extended orientation of FIG. 3, the pipe receiving region 64 is positioned at the drive axis X—X of the drive head 32. As so positioned, a pipe held within the pipe receiving region 64 is preferably placed in coaxial alignment with the drive axis X—X.

Figure 4:
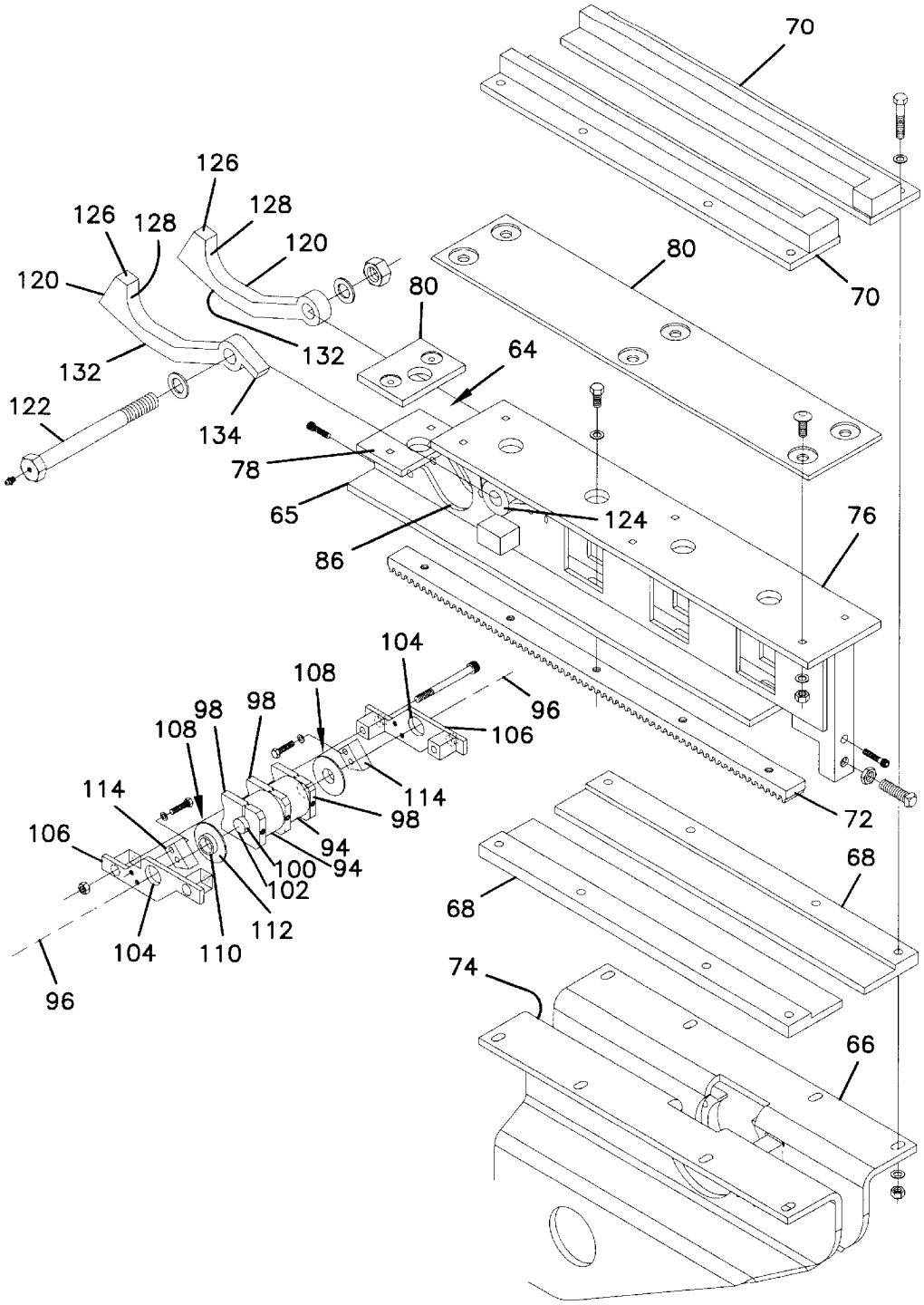
FIG. 4 is an exploded view of one of the pipe transfer members used by the machine of FIG. 1.

As shown in FIG. 4, the pipe transfer member 46 is slidably mounted on a lower track 66. Wear strips 68 (e.g., plastic wear strips) are positioned between the pipe transfer member 46 and the track 66. Cover plates 70 are fastened to the track 66 on opposite sides of the pipe transfer member 46. A gear rack 72 is secured to the bottom of the pipe transfer member 46. The gear rack 72 fits within an elongated slot 74 defined by the track 66. The rack 72 cooperates with a drive gear (not shown), such as a pinion gear driven by a hydraulic motor, to move the pipe transfer member 46 between the extended and retracted orientations.

Referring still to FIG. 4, the pipe transfer member 46 includes a top pipe retaining surface 76 that is used to block the discharge openings 57A–60A. The retaining surface 76 prevents pipes from being discharged from the columns 57–60 when such columns contain pipes, and the pipe receiving region 64 of the pipe transfer member 46 is not positioned below a selected one of the columns 57–60. The pipe transfer member. 46 also includes a lower platform 78 that is recessed relative to the pipe retaining surface 76. Both the lower platform 78 and the pipe retaining surface 76 are covered by wear strips 80 preferably made of a suitable plastic-type material.

Figure 5:
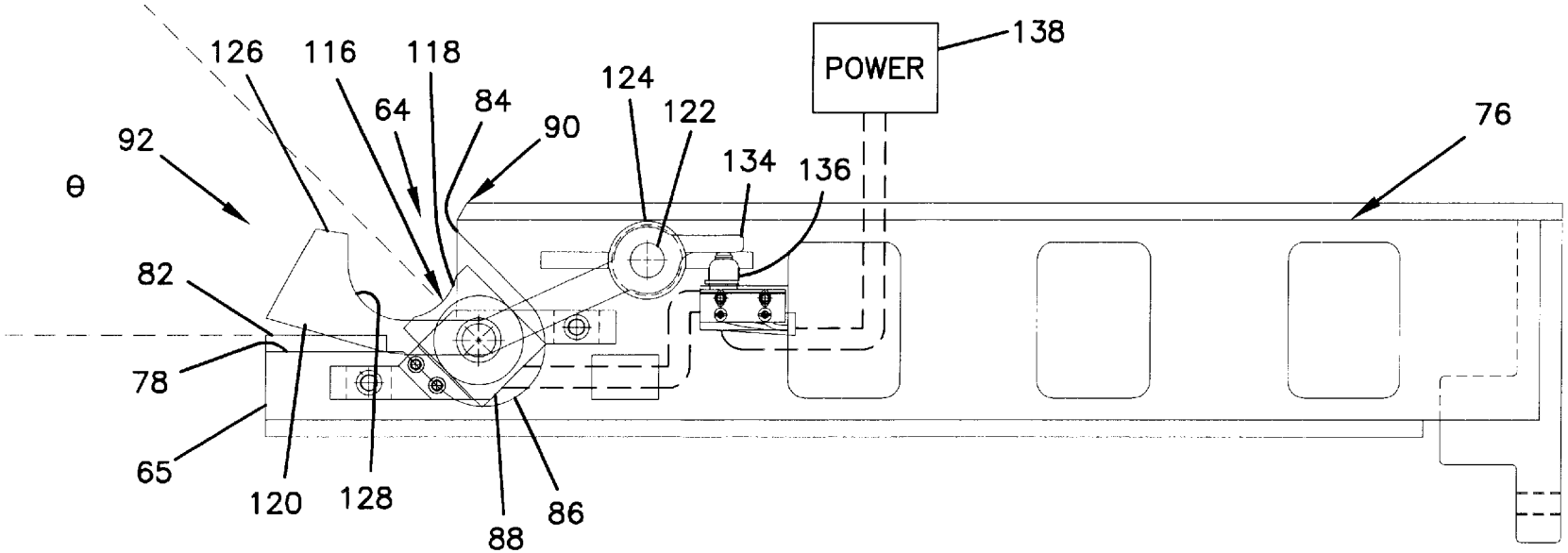
FIG. 5 illustrates the pipe transfer member of FIG. 4 as assembled.

The lower platform 78 is positioned at the end 65 of the pipe transfer member 46 that is closest to the drive head 34. Referring to FIG. 5, the lower platform 78 includes a top surface 82 that is aligned generally along a horizontal plane. The pipe transfer member 46 also includes an upright wall 84 positioned adjacent the pipe receiving region 64. A magnet pocket 86 is positioned at least partially between the upright wall 84 and the lower platform 78. A magnet 88 is mounted within the magnet pocket 86. The lower platform 78, the upright wall 84 and the magnet 88 cooperate to define a partial pocket at the pipe receiving region 64. The partial pocket includes a closed side 90 defined by the magnet 88 and the upright wall 84, and an open side 92 located above the lower platform 78 directly at the end 65 of the pipe transfer member 46 that is closest to the drive head 32.

As shown in FIG. 4, the magnet 88 comprises an electromagnet having two electromagnetic coils 94 aligned along a central axis 96. The magnet 88 also includes three ferromagnetic plates 98 that are axially spaced along the axis 96. The coils 94 are positioned between the plates 98. The magnet 88 further includes a ferromagnetic core or rod 100 that is also aligned along the axis 96. The rod 100 extends through the plates 98 and the coils 94. End portions 102 of the rod 100 are pivotally received within holes 104 defined by magnet mounting brackets 106.

The mounting brackets 106 are used to secure the magnet 88 within the magnet pocket 86 of the pipe transfer member 46. Preferably, the mounting brackets 106 are fastened to the pipe transfer member 46 with the magnet 88 captured within the magnet pocket 86 between the two mounting brackets 106. The pivotal connection between the magnet core 100 and the mounting brackets 106 allows the magnet 88 to float or pivot within the magnet pocket 86 about the axis 96. The pivotal movement of the magnet allows the magnet 88 to self align to better hold a pipe received within the pipe receiving region 64. As shown in FIG. 5, the magnet 88 is preferably mounted at an angel θ in the range of 35° to 55° relative to horizontal. In a more preferred embodiment, the angle θ is about 45° relative to horizontal.

To insure adequate magnetic field strength, it is preferred to insulate or isolate the magnet 88 from other metal parts of the pipe transfer member 46. For example, magnetic insulators 108 are provided for insulating the magnet 88 with respect to the mounting brackets 106. The magnetic insulators 108 include cylindrical portions 110 that surround the end portions 102 of the magnetic core 100. The cylindrical portions 110 fit within the holes 104 defined by the mounting brackets 106 thereby insulating the magnetic core 100 from the mounting brackets 106. The magnetic insulators 108 also include washer portions 112 that project radially outward from the cylindrical portions 110 and that insulate the plates 98 from the mounting brackets 106. Additionally, stop members 114 are fastened to the mounting brackets 106 at a location below the magnet 88. The stop members 114 limit the range of pivotal movement of the magnet 88. Additionally, the stop members 114 are preferably made of a dielectric material to further assist in isolating the magnet 88.

Figure 6C:
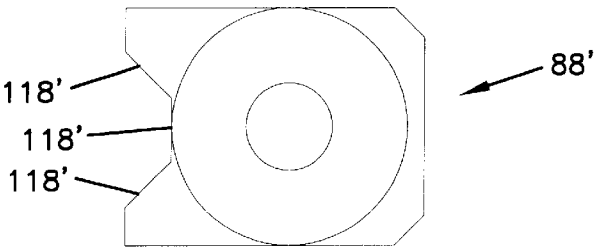
FIG. 6C is a side view of an alternative magnet.
Figure 6B:
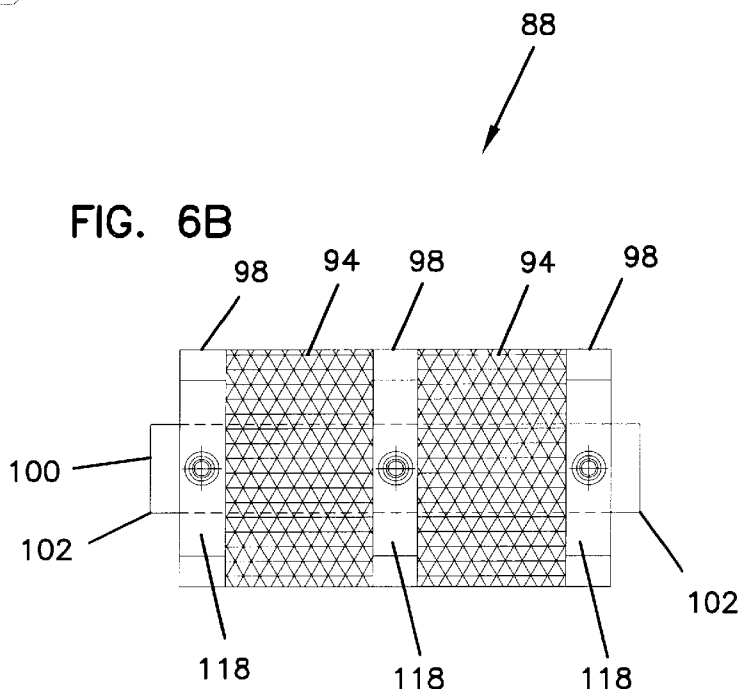
FIG. 6B is a left side view of the magnet of FIG. 6A.
Figure 6A:
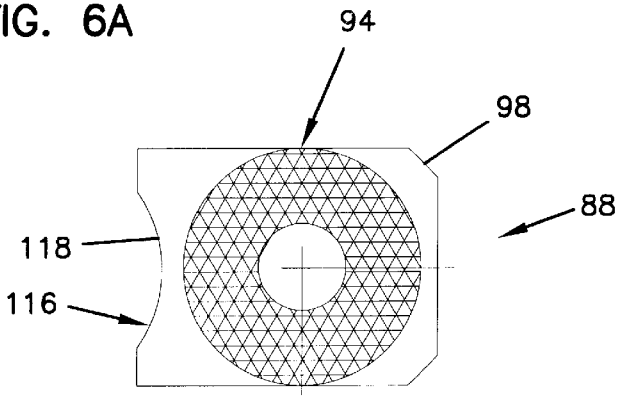
FIG. 6A illustrates a magnet used by the pipe transfer member of FIG. 4.

Referring to FIG. 5, the magnet 88 includes a contoured region 116 that faces outward from the magnet pocket 86 when the magnet 88 is mounted within the pocket 86. The contoured region 116 is preferably contoured to compliment the outer shape of a pipe desired to be handled by the pipe transfer member 46. For example, as shown in FIGS. 6A and 6B, the plates 98 define concave magnetic gripping surfaces 118 adapted to compliment the convex outer surface of a round pipe. When a pipe is placed at the pipe receiving region 64 while the magnet 88 is activated, the pipe is magnetically attracted toward the contoured region 116 of the magnet 88. As the pipe moves toward the magnet 88, the pipe is received and cradled by the concave gripping surfaces 118. Magnetic force provided by the magnet causes the pipe to be magnetically grasped, gripped, held or otherwise retained against the magnetic gripping surfaces 118. The complimentary shape of the gripping surfaces 118 insures that adequate contact is provided between the plates 98 and the pipe. The pivotal nature of the magnet 88 also facilitates providing adequate contact between the plates 98 and the pipe.

Referring again to FIGS. 4 and 5, two assist arms 120 are pivotally connected to the pipe transfer member 46 adjacent to the pipe receiving region 64. The assist arms 120 are connected to opposite sides of the pipe transfer member 46 by a bolt 122 that extends through bosses 124 located on the pipe transfer member 46. The assist arms 120 include upwardly projecting pipe stops 126. Each of the pipe stops 126 includes an inner portion defining a curved surface 128. The assist arms 120 are movable between an upper position (shown in FIGS. 2 and 5) and a lower position (shown in FIG. 3). When the assist arms 120 are in the upper position, the pipe stops 126 block or otherwise obstruct the open side 92 of the partial pocket formed by the pipe transfer member 46. In such a position, the curved surfaces 128 of the assist arms 120 cooperate with the gripping surfaces 118 of the magnet 88 and the upright wall 84 of the pipe transfer member 46 to form a full pocket for receiving and holding a pipe. By contrast, when the assist arms 120 are in the lower position, the pipe stops 126 are positioned completely below a pipe held by the magnet 88 such that the open side 92 of the partial pocket is not obstructed (i.e., the pipe can be horizontally or laterally removed from or inserted into the partial pocket).

The assist arms 120 move to the upper position when the pipe transfer member 46 is moved to the retracted position. Referring to FIG. 2, fixed ramps 130 (only one shown) are positioned on opposite sides of the pipe transfer member 46. When the pipe transfer member 46 is moved to the retracted position, the assist arms 120 contact the fixed ramps causing the assist arms 120 to be pivoted upward to the upper position of FIG. 2. In such an upper position, the fixed ramps 130 engage planar surfaces 132 on the bottoms of the assist arms 120 to prevent the assist arms 120 from pivoting downward while the pipe receiving region 64 of the pipe transfer member 46 is located beneath the magazine 26. The fixed ramps 130 terminate at an outer edge of the magazine 26. As the pipe transfer member 46 is moved from the retracted orientation toward the extended orientation, the assist arms 120 move past the fixed ramps 130 and gravity causes the assist arms 120 to pivot from the upper position to the lower position.

As illustrated in FIGS. 6A and 6B, the gripping surfaces 118 are curved so as to compliment a curved pipe. For pipes having different shapes, (e.g., hexagonal or other polygonal shapes) it is desirable to have gripping surfaces with other than curved contours. For example, FIG. 6C shows a magnet 88' adapted to accommodate a polygonal pipe. The magnet 88' includes a plurality of planar gripping surfaces 118' that are angled relative to one another so as to compliment at least a portion of a polygonal pipe desired to be handled by the pipe transfer member 46. As used herein, the term "pipe" is intended to include any type of structure used in drill strings (e.g., pipes, rods, etc.) having any type of cross-sectional configuration (e.g., round, polygonal, hexagonal).

While in certain embodiments, exclusively the magnet 88 can be used for retaining a pipe at the pipe receiving region 64, the use of the assist arms 120 in combination with the magnet 88 provides numerous advantages. For example, when a pipe is being loaded from a column of the magazine 28 to the pipe receiving region 64, the weight of the stacked pipes can cause the pipe being loaded to be forced away from the magnet 88. To overcome this force, a relatively large magnet would be required. However, by using the assist arms 120 in combination with the magnet 88, a smaller magnet can be used. Additionally, when the magnet 88 is positioned beneath the magazine 26, the magnet is attracted to the metal of the magazine 28 thereby possibly interfering with the smooth movement of the pipe transfer member 46. By using the assist arms 120, the magnet 88 can be de-activated when the pipe receiving region 64 is beneath the magazine 26 thereby eliminating this possible problem.

Referring to FIG. 5, one of the assist arms 120 includes a lever 134 positioned above a switch 136. The switch 136 is electrically connected to a source of electricity 138 (e.g., a 12 volt, 3 amp power source) and is also electrically connected to the electromagnetic coils 94 of the magnet 88. When the assist arm 120 is in the upper position of FIG. 5, the lever 134 holds the switch 136 in a first position in which no electricity is provided to the electromagnetic coils 94. However, when the assist arm 120 pivots to the lower position, the switch 136 moves to a second position in which electricity is provided from the power source 138 to the electromagnetic coils 94. In this manner, the assist arm 120 activates the magnet 88 when the pipe receiving location 64 of the pipe transfer member 46 is moved away from the magazine 26, and deactivates the magnet 88 when the pipe receiving region 64 is moved beneath the magazine 26.

When the pipe transfer member 46 is moved to the extended position, it is preferred to exclusively use the magnet 88 to hold the pipe in alignment with the drive X—X of the drive head 32. With the assist arms 120 pivoted to the lower position, no mechanical members oppose the gripping surfaces of the magnet 88. This is advantageous because it allows the pipe transfer member 46 to be retracted immediately after the pipe has been coupled to the drive member 34 of the drive head 32. In other words, it is not necessary to first move an opposing pipe stop out of the way before retracting the pipe transfer member 46. Also, no additional lift mechanisms are needed to lift the pipe from the partial pocket prior to retraction of the pipe transfer member 46.

While the magnet 88 is preferably an electromagnet, it will be appreciated that in alternate embodiments other types of magnets (e.g., permanent magnets) could be used.

IV. Magazine Loading and Unloading Operations

To unload a pipe from the first column 57 of the magazine 26, the pipe transfer members 46 are moved to the retracted position such that the pipe receiving regions 64 are located directly beneath the discharge opening 57A. With the pipe transfer members 46 so positioned, the pipe lifts 52 are lowered causing the lower most pipe in the first column 57 to move through the discharge opening 57A into the pipe receiving regions 64. The pipe retaining surfaces 76 of the pipe transfer members 46 prevent any pipes from being discharged through any of the discharge openings 58A–60A. In the retracted position of FIG. 2, the magnets 88 are deactivated and the assist arms 120 are in the upper positions. Consequently, the assist arms 120 retain the loaded pipe at the pipe receiving regions 64 while the pipe receiving regions 64 are located beneath the magazine 26.

After the pipe has been loaded into the pipe receiving regions 64, the pipe transfer members 46 are moved toward the extended orientation. As the pipe receiving regions 64 move from beneath the magazine 26, the assist arms 120 move, via gravity, toward the lower position and the magnets 88 are activated. The activated magnets 88 attract the pipe against gripping surfaces 118. The magnetic attraction provided by the magnets 88 resists lateral movement of the pipe within the partial pockets of the pipe transfer members 46 thereby inhibiting the pipe from falling out of the partial pockets during transfer of the pipe. The magnets 88 also inhibit the pipe from sliding along its axis as the pipe is transferred. For example, during drilling operations, the track 30 and magazine 26 are commonly inclined. Therefore, the pipe has a tendency to slide downward along its axis unless somehow restrained. Friction between the gripping surfaces 118 and the pipe preferably provides sufficient resistance to inhibit the pipe from sliding in an axial direction during transfer of the pipe.

When the pipe transfer members 46 have been fully extended, the gripping surfaces 118 are positioned such that the pipe is held in coaxial alignment with the drive axis X—X of the drive head 32. With the pipe so aligned, the drive member 34 of the drive head 32 can be threaded into the pipe, and the pipe can be drilled into the ground. After the pipe has been coupled to the drive member 34, the pipe transfer members 46 are preferably retracted with sufficient force to overcome the magnetic attraction provided by the magnets 88. Hence, the pipe is disengaged from the magnets 88 and laterally displaced from the pipe receiving regions 64 as the pipe transfer members 46 are retracted. The pipe transfer members 46 are then moved back to the position of FIG. 2 such that another pipe from the first column 57 can be loaded into the pipe receiving regions 64. Before the pipe transfer members 46 are retracted, the pipe lifts 52 can be used to lift the pipes within the magazine 26 to reduce wear of the pipe transfer members 46.

In unloading the magazine 26, the sequence of steps described above are repeated until all of the pipes contained in the first column 57 have been selected. Thereafter, the same procedure is repeated with respect to the second column 58, the third column 59 and the fourth column 60 until all of the pipes from the magazine 26 have been selected.

To load the magazine, the pipe transfer members 46 are extended such that a pipe coupled to the drive member 34 is received in the pipe receiving regions 64. Next, the pipe is uncoupled from the drive member 32 and also uncoupled from the drill string. The uncoupled pipe is magnetically attracted against the magnetic gripping surfaces 118 such that the pipe is magnetically held at the pipe receiving regions 64 of the pipe transfer members 46. With the pipe so held, the pipe transfer members 64 are moved from the extended orientation toward the retracted orientation. As the pipe receiving regions 64 move beneath the magazine 26, the assist arms 120 pivot upward to form a full pocket for holding the pipe, and the magnets 88 are deactivated. The pipe transfer members 46 are then oriented such that the pipe receiving regions 64 are positioned beneath the fourth column 60. Next, the pipe lifts 52 are used to lift the pipe from the pipe receiving regions 64, through the discharge opening 60A and into the fourth column 60. The pipe transfer members 46 are then moved back to the extended orientation to receive another pipe from the drill string, and the pipe lifts 52 are lowered. Thereafter, the sequence is repeated until the fourth column 60 has been filled. After the fourth column 60 has been filled, the same process is repeated with respect to the third column 59, the second column 58 and the first column 57 until the entire magazine has been filled.

It will be appreciated that the loading and unloading sequences will depend upon the particular magazine configuration being used. Consequently, the disclosed unloading and loading cycles are being provided as examples that are not intended to limit the scope of the present invention. For example, in one alternate embodiment, individual, separately actuated pipe stops can be used at each of the discharge openings 57A–60A. For such an embodiment, pipes can be loaded into or unloaded from any of the columns 57–60 at any given time. Therefore, any type of loading or unloading sequence can be used (i.e., the columns can be loaded or unloaded in any order or even randomly).

V. Alternative Holding Structure

Figure 7B:
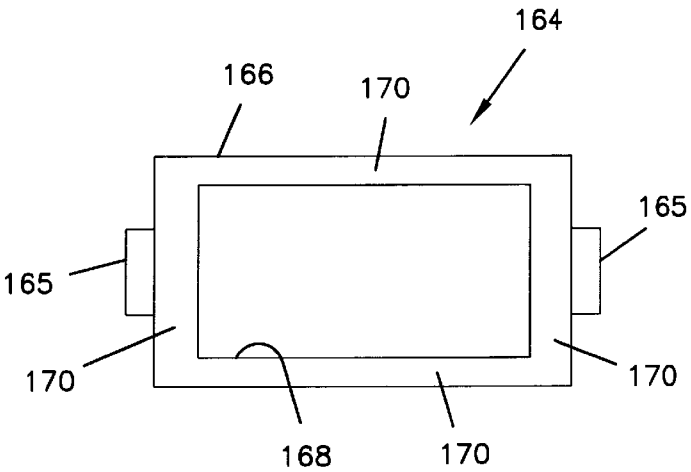
FIG. 7B is a left side view of the pipe holding structure of FIG. 7A.
Figure 7A:
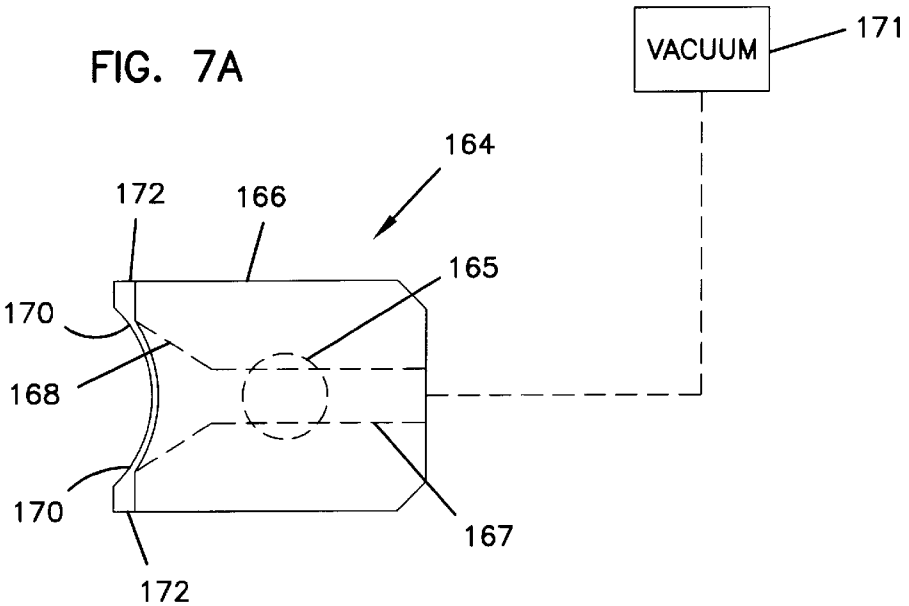
FIG. 7A illustrates an alternative pipe holding mechanism suitable for use with the pipe transfer member of FIGS. 4 and 5.

Referring to FIGS. 7A and 7B, an alternative pipe holding apparatus 164 is illustrated. It will be appreciated that the apparatus 164 is adapted to be mounted in the pocket 86 of the pipe transfer member 46 in a pivotal manner similar to the magnet 88. For example, the apparatus 164 can include pivot members 165 adapted to fit within the holes 104 of the mounting brackets 106.

The holding apparatus 164 includes a vacuum head 166. The vacuum head 166 includes at least one suction opening 168. Pipe gripping surfaces 170 at least partial surround the suction opening 168. The gripping surfaces 170 are preferably contoured so as to compliment an outer surface of a pipe desired to be held. A gasket structure 172 can be provided along the gripping surfaces 170 provide a seal between the vacuum head 168 and a pipe desired to be held.

In use, the vacuum head 166 is preferably mounted in the pocket 86 of the pipe transfer member 46 such that the suction opening 168 faces upward. When a pipe is placed at the pipe receiving region 64, a source of vacuum 171, which is in fluid communication with the suction opening 168, is activated such that the pipe at the pipe receiving region 64 is drawn or attracted toward the suction opening 168. A passageway 167 defined by the vacuum head 166 at least partially provides fluid communication between the suction opening 168 and the source of vacuum 171. Upon being drawn toward the suction opening 168, the pipe is held by suction against the gripping surfaces 170. The gripping surfaces 170 are preferably positioned such that when the pipe transfer member 46 is in the extended orientation, a pipe held against the gripping surfaces 170 is retained in coaxial alignment with the drive axis X—X. If it is desired to release the pipe from the vacuum head 166, the pressure at the suction opening 168 is returned to atmospheric pressure.

VI. Drive Head Assembly

Figure 8:
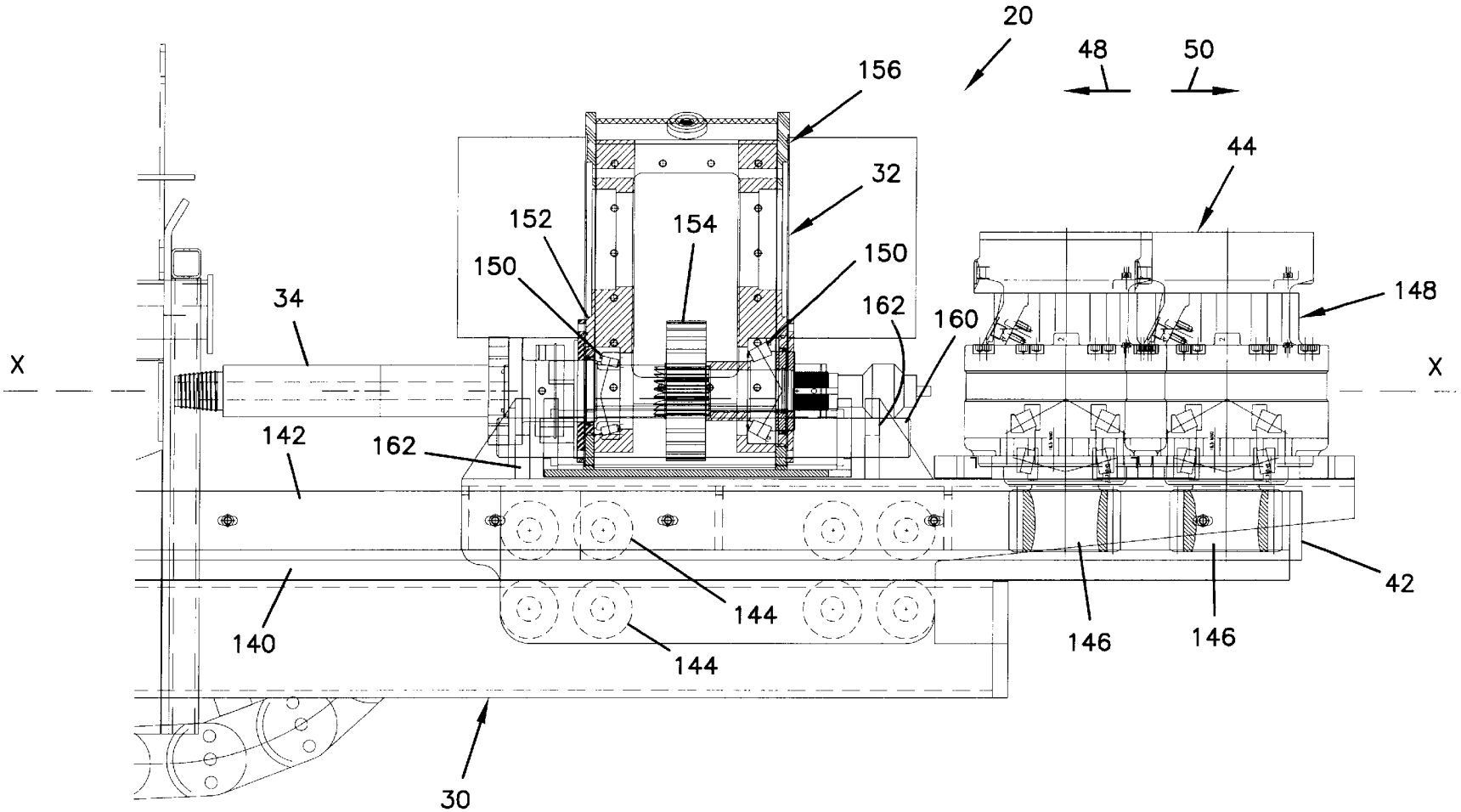
FIG. 8 is an enlarged side view of a drive head of the machine of FIG. 1.
Figure 9:
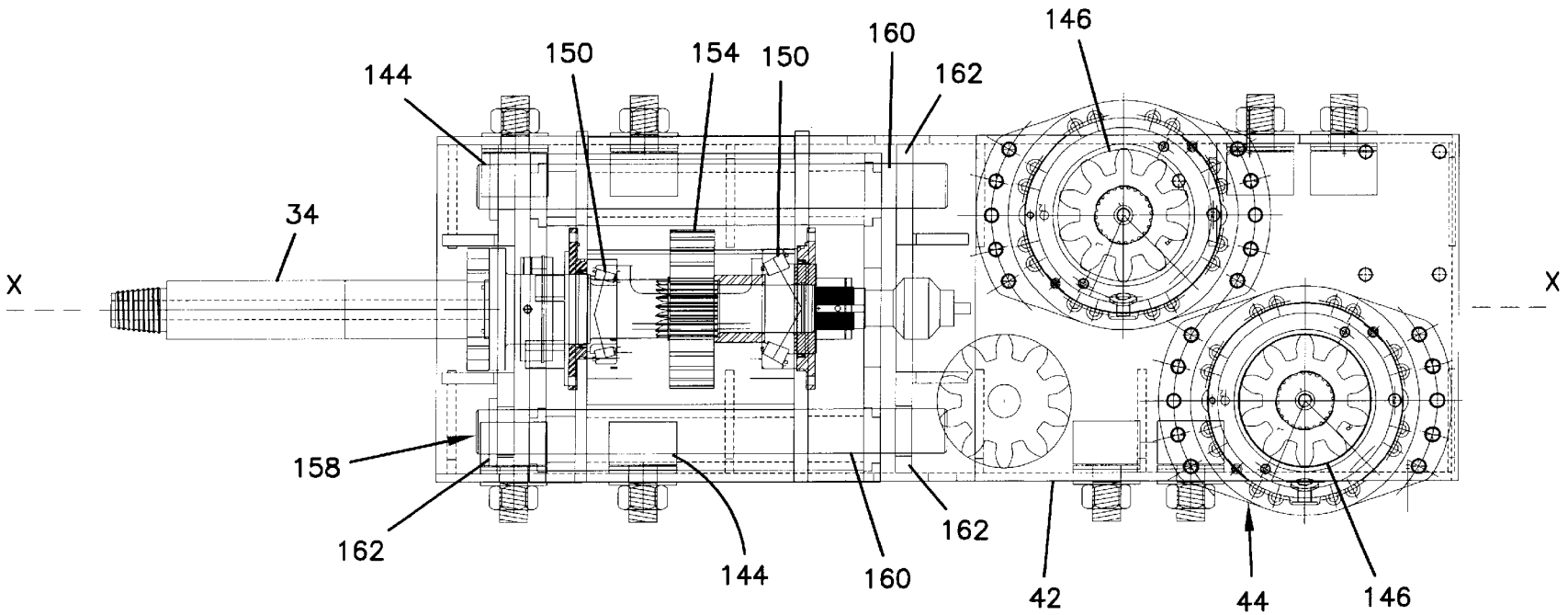
FIG. 9 is a top view of the drive head of FIG. 8.
Figure 10:
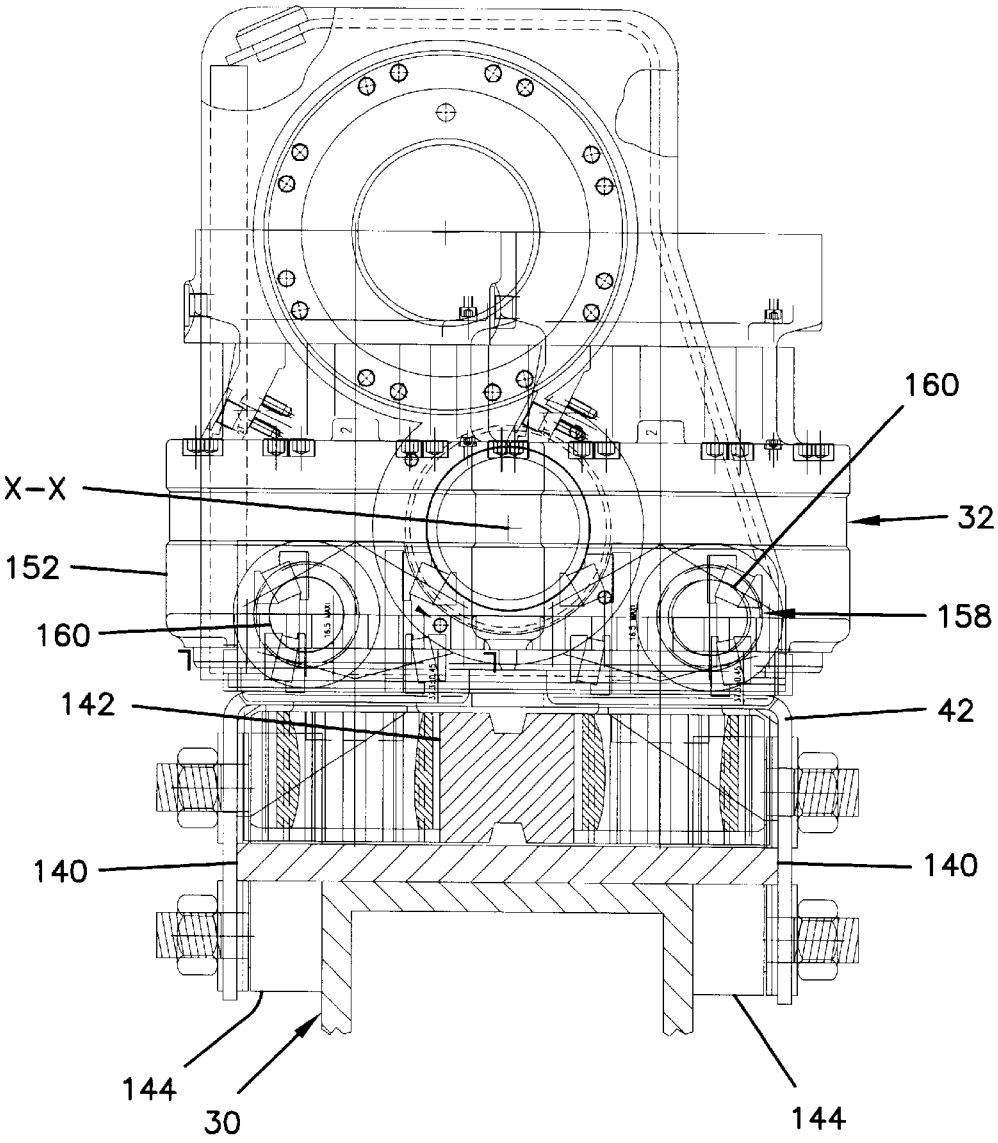
FIG. 10 is an end view of the drive head of FIG. 8.

Referring to FIGS. 8–10, the elongated track 30 of the drilling apparatus 20 includes transversely extending flanges 140 that extend along the length of the track 30. The track also includes a gear rack 142 that extends along the length of the track 30. The carriage 42 is secured to the track 30 by rollers 144 that are positioned above and below the flanges 140. The flanges 140 are captured between the rollers 144 and the rollers facilitate moving the carriage 42 along the track 30.

As shown in FIGS. 8–10, the drive mechanism 44 for moving the carriage 42 along the elongated track 30 is a rack and pinion system. The system includes pinion gears 146 that intermesh with opposite sides of the gear rack 142. The pinion gears 146 are driven by hydraulic motors 148. By driving the pinion gears 146 in a first direction, the carriage is propelled in the direction 48 along the track 30. By contrast, by driving the pinion gears 146 in a second direction, the carriage 42 is propelled in the direction 50 along the track 30.

While the drive mechanism 44 has been described as a rack and pinion system, it will be appreciated that other types of drive mechanisms could also be used. For example, chain drive systems, hydraulic/pneumatic cylinder type systems, as well as other systems, could also be used. Also, while hydraulic motors 148 are preferred, other types of drives such as pneumatic motors, electric motors, internal combustion engines or the like could also be used.

Referring to FIG. 8, the drive member 34 of the drive head 32 is mounted within bearings 150 secured to a head frame 152. A gear 154 is mounted on the drive member 34 at a location between the bearings 150. The drive mechanism 38 comprises a hydraulic motor 156 operatively coupled to the gear 154. The drive member 34 is rotated in a given direction about the drive axis X—X by torque transferred from the hydraulic motor 156 through the gear 154 to the drive member 34. In addition to the hydraulic motor 156, other types of drive arrangements (e.g., electric motors, pneumatic motors, internal combustion engines or the like) could also be used.

The head frame 152 is connected to the carriage 42 by a slide structure 158 that forms a mechanical interface between the drive head 32 and the carriage 42. The slide structure 158 includes two linear bearings 160 (e.g., pins, dowels, etc.) that are fixedly connected to the carriage 42 by flanges 162. The head frame 152 is slidably mounted on the linear bearings 160. For example, the head frame 152 is mounted on the linear bearings 160 between the flanges 162, and is free to slide along the linear bearings 160 between the flanges 162. In this manner, the flanges 162 form slide stops for preventing the head frame 152 from sliding off the linear bearings 160. The linear bearings 160 are preferably aligned parallel to the drive axis X—X.

The slide structure 158 is arranged and configured to allow the drive head 32 to move along the drive axis X—X relative to the carriage 42. When a pipe is threaded on the drive member 34 of the drive head 32, the carriage 42 remains stationary relative to the track 30 while the drive head 32 is able to move along the drive axis X—X relative to the track 30. Similarly, when a pipe is unthreaded from the drive member 34 of the drive head 32, the carriage 42 remains stationary relative to the track 30 while the drive head 32 is able to move along the drive axis X—X relative to the track 30.

In use of the drilling apparatus 20, a pipe is removed from the magazine 26 and placed in coaxial alignment with the drive axis X—X. Once the drive member 34 is aligned with the drive axis X—X, the drive member 34 and the pipe are threaded together. While the drive member 32 and the pipe are threaded together, the carriage 42 is retained at a fixed location relative to the track 30, and the drive member 34 is moved axially along the drive axis X—X. The movement of the drive member 34 relative to the carriage 42 prevents binding of the drive head 32, the pipe, and the track 30.

The slide structure 158 also assists in preventing binding of the drill apparatus 20 when a pipe is being uncoupled from the drive member 34. To uncouple a pipe, the pipe is commonly clamped or vice gripped. Next, the drive member 34 is unthreaded from the pipe. As the drive member and the pipe are unthreaded, the carriage 42 is retained at a fixed location relative to the track 30, and the drive member 34 moves axially along the drive axis X—X. Finally, the uncoupled pipe is loaded back into the magazine 28.

In addition to allowing the drive head 32 to slide relative to the carriage 42, the slide mechanism also allows torque to be transferred between the drive head 32 and the carriage 42. For example, when torque is applied to the drive member 34 by the drive mechanism 38, a reactive torque load is applied through the slide structure 158 to the carriage 42. From the carriage 42, the reactive torque load is transferred to the track 30.

It is to be understood that the present invention is not limited to the particular construction and arrangement of parts disclosed and illustrated herein, but embraces all such modified forms thereof as come within the scope of the following claims.

We claim:

1. A drilling apparatus comprising:

a magazine for holding a plurality of pipes, the magazine including a plurality of vertical columns;

a drive head including a drive member adapted to be coupled to a pipe, the drive member being aligned along a drive axis;

a first drive mechanism for rotating the drive member about the drive axis;

a second drive mechanism for moving the drive member axially along the drive axis;

a pipe transfer member for transferring pipes between the magazine and the drive head, the pipe transfer member defining a pipe receiving region for receiving a pipe, the pipe transfer member being movable to a position where the pipe receiving region is positioned beneath the magazine; and a pipe retainer moveable between a retaining position and a non-retaining position, the pipe retainer preventing lateral movement of a pipe from the pipe receiving region of the pipe transfer member when in the retaining position, the pipe retainer allowing lateral movement of a pipe from the pipe receiving region when in the non-retaining position, the pipe retainer being positioned in the retaining position only when the pipe receiving region of the pipe transfer member is located beneath the magazine.

2. The drilling apparatus of claim 1 wherein the pipe retainer is an assist arm.

3. The drilling apparatus of claim 2 wherein the pipe transfer member defines only a partial pocket at the pipe receiving region, the partial pocket including a closed side positioned opposite from an open side, and wherein the assist arm cooperates with the partial pocket to form a complete pocket.

4. The drilling apparatus of claim 3 wherein the assist arm is mechanically raised to cooperate with the partial pocket of the transfer member when the pipe transfer member is retracted such that the pipe receiving region is located beneath the magazine.

5. The drilling apparatus of claim 1, wherein the pipe retainer is a retaining member, and wherein the drilling apparatus includes a fixed ramp, and wherein the fixed ramp directs the retaining member upwards from the non-retaining position to the retaining position as the pipe receiving region of the pipe transfer member is moved beneath the magazine.

6. The drilling apparatus of claim 1, further comprising a ramp for deflecting the pipe retainer upwards from the non-retaining position to the retaining position as the pipe transfer member is moved from the second orientation toward the first orientation.

7. The drilling apparatus of claim 1, further comprising a pipe holder for holding a pipe at the pipe receiving location when the pipe retainer is in the non-retaining position.

8. A drilling apparatus comprising:

a magazine for holding a plurality of pipes, the magazine including a top end and a bottom end, the magazine including a plurality of columns that extend between the top and bottom ends of the magazine;

a pipe transfer member for transferring pipes to and from the magazine, the pipe transfer member defining a pipe receiving region for receiving a pipe, the pipe transfer member being movable to a position in which the pipe receiving region is located beneath the magazine;

a pipe retainer moveable between a raised position and a lowered position; and a cam for moving the pipe retainer from the lowered position to the raised position when the pipe receiving location of the pipe transfer member is moved beneath the magazine.

9. The drilling apparatus of claim 8, wherein the cam includes a fixed ramp positioned adjacent to the magazine.

10. A drilling apparatus comprising:

a magazine for holding a plurality of pipes, the magazine including a top end and a bottom end, the magazine including a plurality of columns that extend between the top and bottom ends of the magazine;

a pipe transfer member for transferring pipes to and from the magazine, the pipe transfer member defining a pipe receiving region for receiving a pipe, the pipe transfer member being movable to a position in which the pipe receiving region is located beneath the magazine;

a pipe retainer for holding a pipe at the pipe receiving region of the pipe transfer member, the pipe retainer being moveable between a blocking position and a non-blocking position; and a cam for moving the pipe retainer from the non-blocking position to the blocking position when the pipe receiving location of the pipe transfer member is moved beneath the magazine.

11. The drilling apparatus of claim 10, wherein the cam includes a fixed ramp positioned adjacent to the magazine.

* * * * *